US007868857B2

(12) United States Patent
Nathan et al.

(10) Patent No.: US 7,868,857 B2
(45) Date of Patent: Jan. 11, 2011

(54) METHOD AND SYSTEM FOR COMPENSATION OF NON-UNIFORMITIES IN LIGHT EMITTING DEVICE DISPLAYS

(75) Inventors: Arokia Nathan, Waterloo (CA); Stefan Alexander, Waterloo (CA); Peyman Servati, Waterloo (CA); G. Reza Chaji, Waterloo (CA); Rick I-Heng Huang, Waterloo (CA); Corbin Church, Outremont (CA)

(73) Assignee: Ignis Innovation Inc., Kitchener, Ontario (CA)

( * ) Notice: Subject to any disclaimer, the term of this patent is extended or adjusted under 35 U.S.C. 154(b) by 968 days.

(21) Appl. No.: 11/402,624

(22) Filed: Apr. 12, 2006

(65) Prior Publication Data

US 2006/0273997 A1 Dec. 7, 2006

(30) Foreign Application Priority Data

Apr. 12, 2005 (CA) ..... 2504571

(51) Int. Cl.
*G09G 3/32* (2006.01)

(52) U.S. Cl. ..... 345/82; 345/83; 345/690

(58) Field of Classification Search ..... 345/82–83, 345/204, 690

See application file for complete search history.

(56) References Cited

U.S. PATENT DOCUMENTS

| | | | | |
|---|---|---|---|---|
| 5,489,918 | A | 2/1996 | Mosier | |
| 6,271,825 | B1 | 8/2001 | Greene et al. | |
| 6,525,683 | B1 | 2/2003 | Gu | |
| 6,806,497 | B2 | 10/2004 | Jo | |
| 6,815,975 | B2 | 11/2004 | Nara et al. | |
| 2001/0024181 | A1 * | 9/2001 | Kubota et al. | 345/87 |
| 2003/0122813 | A1 | 7/2003 | Ishizuki et al. | |
| 2003/0210256 | A1 | 11/2003 | Mori et al. | |
| 2004/0108518 | A1 | 6/2004 | Jo | |
| 2007/0075727 | A1 * | 4/2007 | Nakano et al. | 324/770 |
| 2007/0076226 | A1 * | 4/2007 | Klompenhouwer et al. | 358/1.1 |

FOREIGN PATENT DOCUMENTS

| | | |
|---|---|---|
| CA | 2 522 396 | 11/2004 |
| EP | 1 469 448 A | 10/2004 |
| WO | WO 03/058594 A1 | 7/2003 |
| WO | 2004/025615 A | 3/2004 |
| WO | 2005/022500 A | 3/2005 |

OTHER PUBLICATIONS

Alexander et al.: "Pixel circuits and drive schemes for glass and elastic AMOLED displays"; dated Jul. 2005 (9 pages).

(Continued)

*Primary Examiner*—Amr Awad
*Assistant Examiner*—Leonid Shapiro
(74) *Attorney, Agent, or Firm*—Nixon Peabody LLP

(57) ABSTRACT

A method and system for compensation of non-uniformities in light emitting device displays is provided. The system includes a module for estimating degradation of an entire pixel circuit based on measurement of a part of the pixel circuit. Based on the estimation, a correction factor is produced to correct non-uniformity of the display.

28 Claims, 12 Drawing Sheets

OTHER PUBLICATIONS

Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A novel driving scheme for high-resolution large-area a-Si:H AMOLED displays"; dated Aug. 2005 (4 pages).
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "eUTDSP: a design study of a new VLIW-based DSP architecture"; dated My 2003 (4 pages).
Chaji et al.: "High Speed Low Power Adder Design With A New Logic Style: Pseudo Dynamic Logic (SDL)"; dated Oct. 2001 (4 pages).
European Search Report for European Application No. EP 06 72 1798 dated Nov. 12, 2009 (2 pages).
International Search Report for International Application No. PCT/CA2006/000549 dated Jul. 27, 2006 (3 pages).
Matsueda y et al.: "35.1: 2.5-in. AMOLED with Integrated 6-bit Gamma Compensated Digital Data Driver"; dated May 2004.
Nathan et al.: "Driving schemes for a-Si and LTPS AMOLED displays"; dated Dec. 2005 (11 pages).
Philipp: "Charge transfer sensing" SENSOR REVIEW vol. 19, No. 2, Dec. 31, 1999, 10 pages.
Safavaian et al.: "Three-TFT image sensor for real-time digital X-ray imaging"; dated Feb. 2, 2006 (2 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).

* cited by examiner

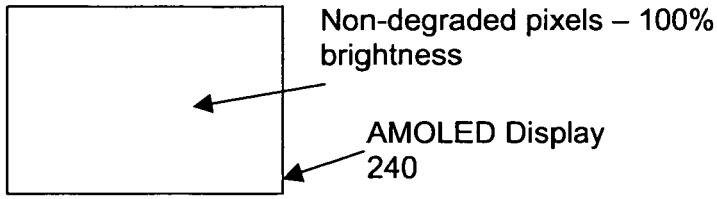

Fig. 11A: t=0h: The video source outputs equal luminance data for each pixel (maximum brightness).

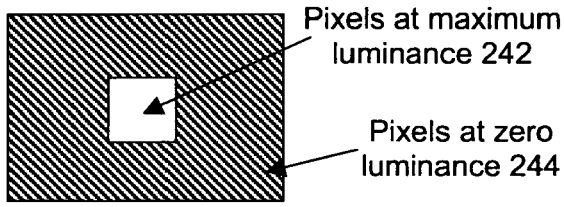

Fig. 11B: t=0h – 1000h: The video source outputs maximum luminance data for some pixels, and zero luminance data for other pixels.

t=1000h: The video source outputs equal luminance data for each pixel. The results are different depending on the compensation algorithm used.

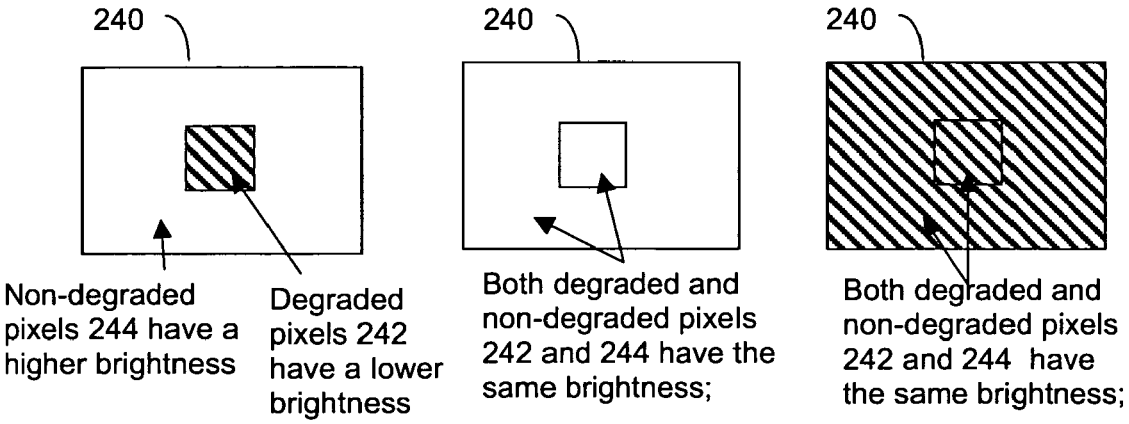

Fig. 11C (No compensation algorithm):

Fig. 11D (Constant brightness algorithm)

Fig. 11E: (Decreasing brightness algorithm):

METHOD AND SYSTEM FOR COMPENSATION OF NON-UNIFORMITIES IN LIGHT EMITTING DEVICE DISPLAYS

FIELD OF INVENTION

The present invention relates to display technologies, more specifically a method and system for compensating for non-uniformities of elements in light emitting device displays.

BACKGROUND OF THE INVENTION

Active-Matrix Organic Light-Emitting Diode (AMOLED) displays are well known art. Amorphous silicon is, for example, one of promising materials for the AMOLED displays, due to its low cost and vast installed infrastructure from TFT-LCD fabrication.

All AMOLED displays, regardless of backplane technology used, exhibit differences in luminance on a pixel to pixel basis, primarily as a result of process or construction inequalities, or from aging caused by operational use over time. Luminance non-uniformities in a display may also arise from natural differences in chemistry and performance from the OLED materials themselves. These non-uniformities must be managed by the AMOLED display electronics in order for the display device to attain commercially acceptable levels of performance for mass-market use.

FIG. 1 illustrates an operational flow of a conventional AMOLED display 10. Referring to FIG. 1, a video source 12 contains luminance data for each pixel and sends the luminance data in the form of digital data 14 to a digital data processor 16. The digital data processor 16 may perform some data manipulation functions, such as scaling the resolution or changing the color of the display. The digital data processor 16 sends digital data 18 to a data driver IC 20. The data driver IC 20 converts that digital data 18 into an analog voltage or current 22, which is sent to Thin Film Transistors (TFTs) 26 in a pixel circuit 24. The TFTs 26 convert that voltage or current 22 into another current 28 which flows through an Organic Light-Emitting Diode (OLED) 30. The OLED 30 converts the current 28 into visible light 36. The OLED 30 has an OLED voltage 32, which is the voltage drop across the OLED. The OLED 30 also has an efficiency 34, which is a ratio of the amount of light emitted to the current through the OLED.

The digital data 14, analog voltage/current 22, current 28, and visible light 36 all contain the exact same information (i.e. luminance data). They are simply different formats of the initial luminance data that came from the video source 12. The desired operation of the system is for a given value of luminance data from the video source 12 to always result in the same value of the visible light 36.

However, there are several degradation factors which may cause errors on the visible light 36. With continued usage, the TFTs 26 will output lower current 28 for the same input from the data driver IC 20. With continued usage, the OLED 30 will consume greater voltage 32 for the same input current. Because the TFT 26 is not a perfect current source, this will actually reduce the input current 28 slightly. With continued usage, the OLED 30 will lose efficiency 34, and emit less visible light for the same input current.

Due to these degradation factors, the visible light output 36 will be less over time, even with the same luminance data being sent from the video source 12. Depending on the usage of the display, different pixels may have different amounts of degradation.

Therefore, there will be an ever-increasing error between the required brightness of some pixels as specified by the luminance data in the video source 12, and the actual brightness of the pixels. The result is that the desired image will not show properly on the display.

One way to compensate for these problems is to use a feedback loop. FIG. 2 illustrates an operational flow of a conventional AMOLED display 40 which includes the feedback loop. Referring to FIG. 2, a light detector 42 is employed to directly measure the visible light 36. The visible light 36 is converted into a measured signal 44 by the light detector 42. A signal converter 46 converts the measured visible light signal 44 into a feedback signal 48. The signal converter 46 may be an analog-to-digital converter, a digital-to-analog converter, a microcontroller, a transistor, or another circuit or device. The feedback signal 48 is used to modify the luminance data at some point along its path, such as an existing component (e.g. 12, 16, 20, 26, 30), a signal line between components (e.g. 14, 18, 22, 28, 36), or combinations thereof.

Some modifications to existing components, and/or additional circuits may be required to allow the luminance data to be modified based on the feedback signal 48 from the signal converter 46. If the visible light 36 is lower than the desired luminance from video source 12, the luminance signal may be increased to compensate for the degradation of the TFT 26 or the OLED 30. This results in that the visible light 36 will be constant regardless of the degradation. This compensation scheme is often known as Optical Feedback (OFB). However, in the system of FIG. 2, the light detector 42 must be integrated onto a display, usually within each pixel and coupled to the pixel circuitry. Not considering the inevitable issues of yield when integrating a light detector into each pixel, it is desirable to have a light detector which does not degrade itself, however such light detectors are costly to implement, and not compatible with currently installed TFT-LCD fabrication infrastructure.

Therefore, there is a need to provide a method and system which can compensate for non-uniformities in displays without measuring a light signal.

SUMMARY OF THE INVENTION

It is an object of the invention to provide a method and system that obviates or mitigates at least one of the disadvantages of existing systems.

In accordance with an aspect of the present invention there is provided a system for compensating non-uniformities in a light emitting device display which includes a plurality of pixels and a source for providing pixel data to each pixel circuit, which includes: a module for modifying the pixel data applied to one or more than one pixel circuit, including: an estimating module for estimating a degradation of a first pixel circuit based on measurement data read from a part of the first pixel circuit; and a compensating module for correcting the pixel data applied to the first or a second pixel circuit based on the estimation of the degradation of the first pixel circuit.

In accordance with a further aspect of the present invention there is provided a method of compensating non-uniformities in a light emitting device display having a plurality of pixels, including the steps of: estimating a degradation of the first pixel circuit based on measurement data read from a part of the first pixel circuit; and correcting pixel data applied to the first or a second pixel circuit based on the estimation of the degradation of the first pixel circuit.

This summary of the invention does not necessarily describe all features of the invention.

BRIEF DESCRIPTION OF THE DRAWINGS

These and other features of the invention will become more apparent from the following description in which reference is made to the appended drawings wherein:

FIGS. 11A-11E illustrate experimental results of the compensation scheme applied to the system of FIG. 3.

DETAILED DESCRIPTION

Embodiments of the present invention are described using an AMOLED display which includes a pixel circuit having TFTs and an OLED. However, the transistors in the pixel circuit may be fabricated using amorphous silicon, nano/micro crystalline silicon, poly silicon, organic semiconductors technologies (e.g. organic TFT), NMOS technology, CMOS technology (e.g. MOSFET), or combinations thereof. The transistors may be a p-type transistor or n-type transistor. The pixel circuit may include a light emitting device other than OLED. In the description below, "pixel" and "pixel circuit" may be used interchangeably.

Figure 3:
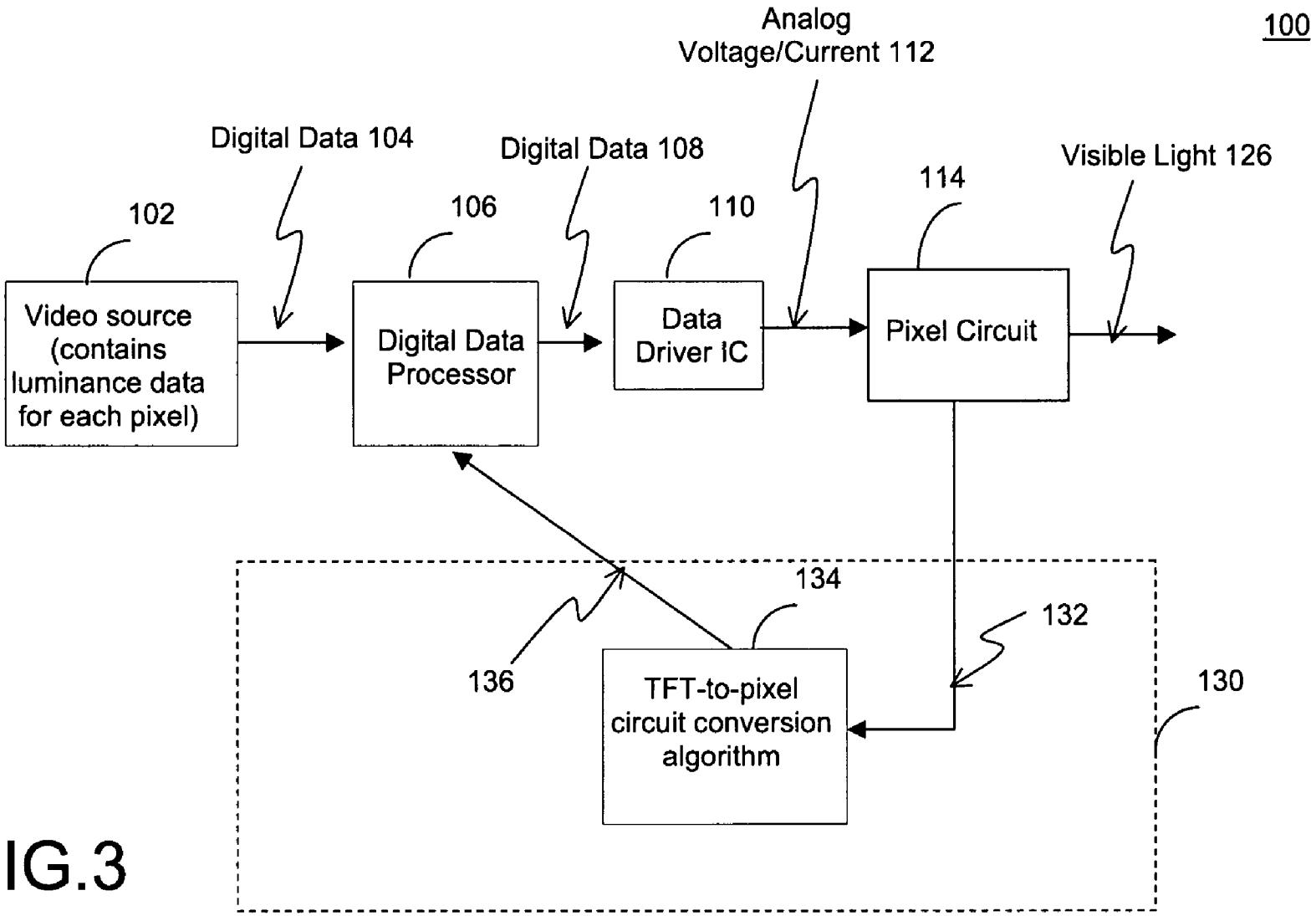
FIG. 3 illustrates a light emitting display system to which a compensation scheme in accordance with an embodiment of the present invention is applied.

FIG. 3 illustrates the operation of a light emitting display system 100 to which a compensation scheme in accordance with an embodiment of the present invention is applied. A video source 102 contains luminance data for each pixel and sends the luminance data in the form of digital data 104 to a digital data processor 106. The digital data processor 16 may perform some data manipulation functions, such as scaling the resolution or changing the color of the display. The digital data processor 106 sends digital data 108 to a data driver IC 110. The data driver IC 110 converts that digital data 108 into an analog voltage or current 112. The analog voltage or current 112 is applied to a pixel circuit 114. The pixel circuit 114 includes TFTs and an OLED. The pixel circuit 114 outputs a visible light 126 based on the analog voltage or current 112.

Figure 1:
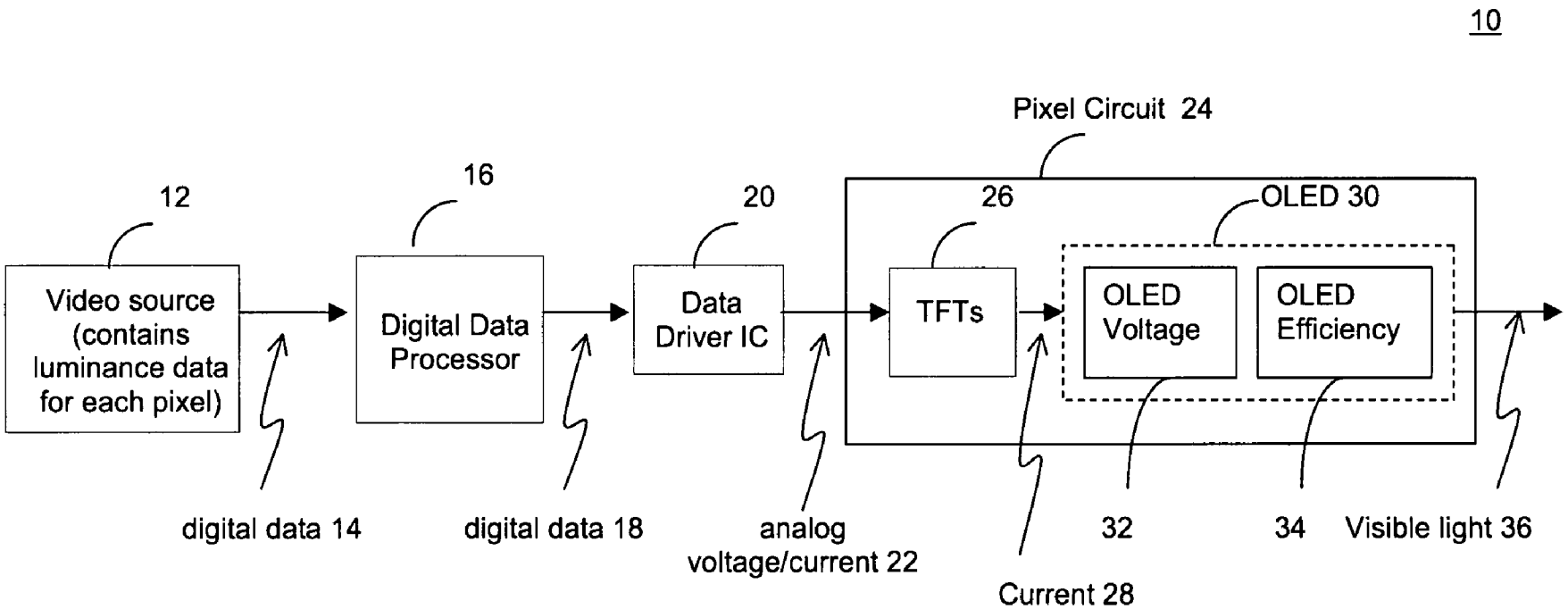
FIG. 1 illustrates a conventional AMOLED system.
Figure 2:
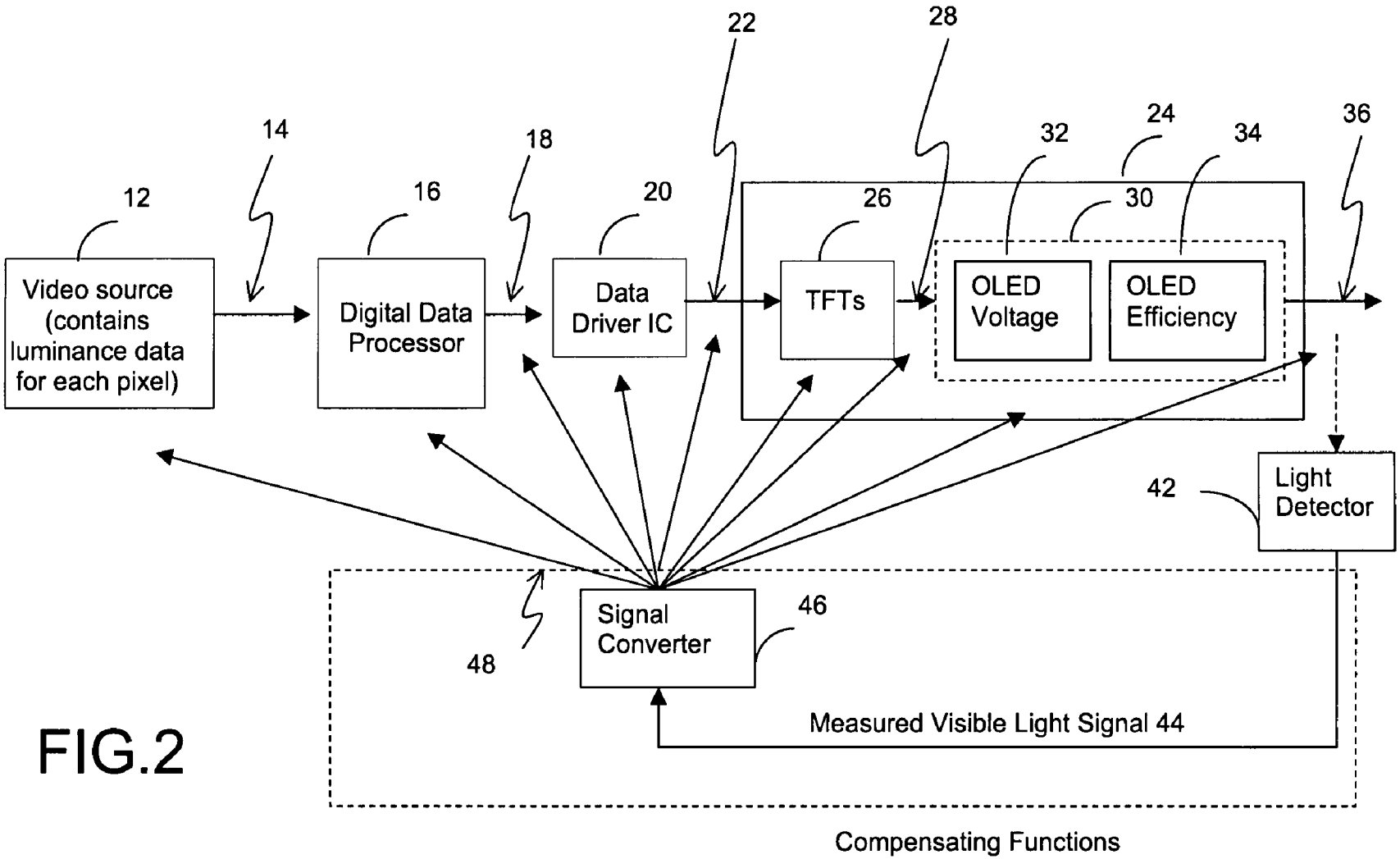
FIG. 2 illustrates a conventional AMOLED system which includes a light detector and a feedback scheme which uses the signal from the light detector.

In FIG. 3, one pixel circuit is shown as an example. However, the light emitting display system 100 includes a plurality of pixel circuits. The video source 102 may be similar to the video source 12 of FIGS. 1 and 2. The data driver IC 110 may be similar to the data driver IC 20 of FIGS. 1 and 2.

A compensation functions module 130 is provided to the display. The compensation functions module 130 includes a module 134 for implementing an algorithm (referred to as TFT-to-pixel circuit conversion algorithm) on measurement 132 from the pixel circuit 114 (referred to as degradation data, measured degradation data, measured TFT degradation data or measured TFT and OLED degradation data), and outputs calculated pixel circuit degradation data 136. It is noted that in the description below, "TFT-to-pixel circuit conversion algorithm module" and "TFT-to-pixel circuit conversion algorithm" may be used interchangeably.

The degradation data 132 is electrical data which represents how much a part of the pixel circuit 114 has been degraded. The data measured from the pixel circuit 114 may represent, for example, one or more characteristics of a part of the pixel circuit 114.

The degradation data 132 is measured from, for example, one or more thin-film-transistors (TFTs), an organic light emitting device (OLED), or a combination thereof. It is noted that the transistors of the pixel circuit 114 is not limited to the TFTs, and the light emitting device of the pixel circuit 14 is not limited to the OLED. The measured degradation data 132 may be digital or analog data. The system 100 provides compensation data based on measurement from a part of the pixel circuit (e.g. TFT) to compensate for non-uniformities in the display. The non-uniformities may include brightness non-uniformity, color non-uniformity, or a combination thereof. Factors for causing such non-uniformities may include, but not limited to, process or construction inequalities in the display, aging of pixel circuits, etc.

The degradation data 132 may be measured at a regular timing or a dynamically regulated timing. The calculated pixel circuit degradation data 136 may be compensation data to correct non-uniformities in the display. The calculated pixel circuit degradation data 136 may include any parameters to produce the compensation data. The compensation data may be used at a regular timing (e.g. each frame, regular interval, etc) or dynamically regulated timing The measured data, compensation data or a combination thereof may be stored in a memory (e.g. 142 of FIG. 8).

The TFT-to-pixel circuit conversion algorithm module 134 or the combination of the TFT-to-pixel circuit conversion algorithm module 134 and the digital data processor 106 estimates the degradation of the entire pixel circuit based on the measured degradation data 132. Based on this estimation, the entire degradation of the pixel circuit 114 is compensated by adjusting, at the digital data processor 106, the luminance data (digital data 104) applied to a certain pixel circuit(s).

The system 100 may modify or adjust luminance data 104 applied to a degraded pixel circuit or non-degraded pixel circuit. For example, if a constant value of visible light 126 is desired, the digital data processor 106 increases the luminance data for a pixel that is highly degraded, thereby compensating for the degradation.

In FIG. 3, the TFT-to-pixel circuit conversion algorithm module 134 is provided separately from the digital data processor 106. However, the TFT-to-pixel circuit conversion algorithm module 134 may be integrated into the digital data processor 106.

Figure 4:
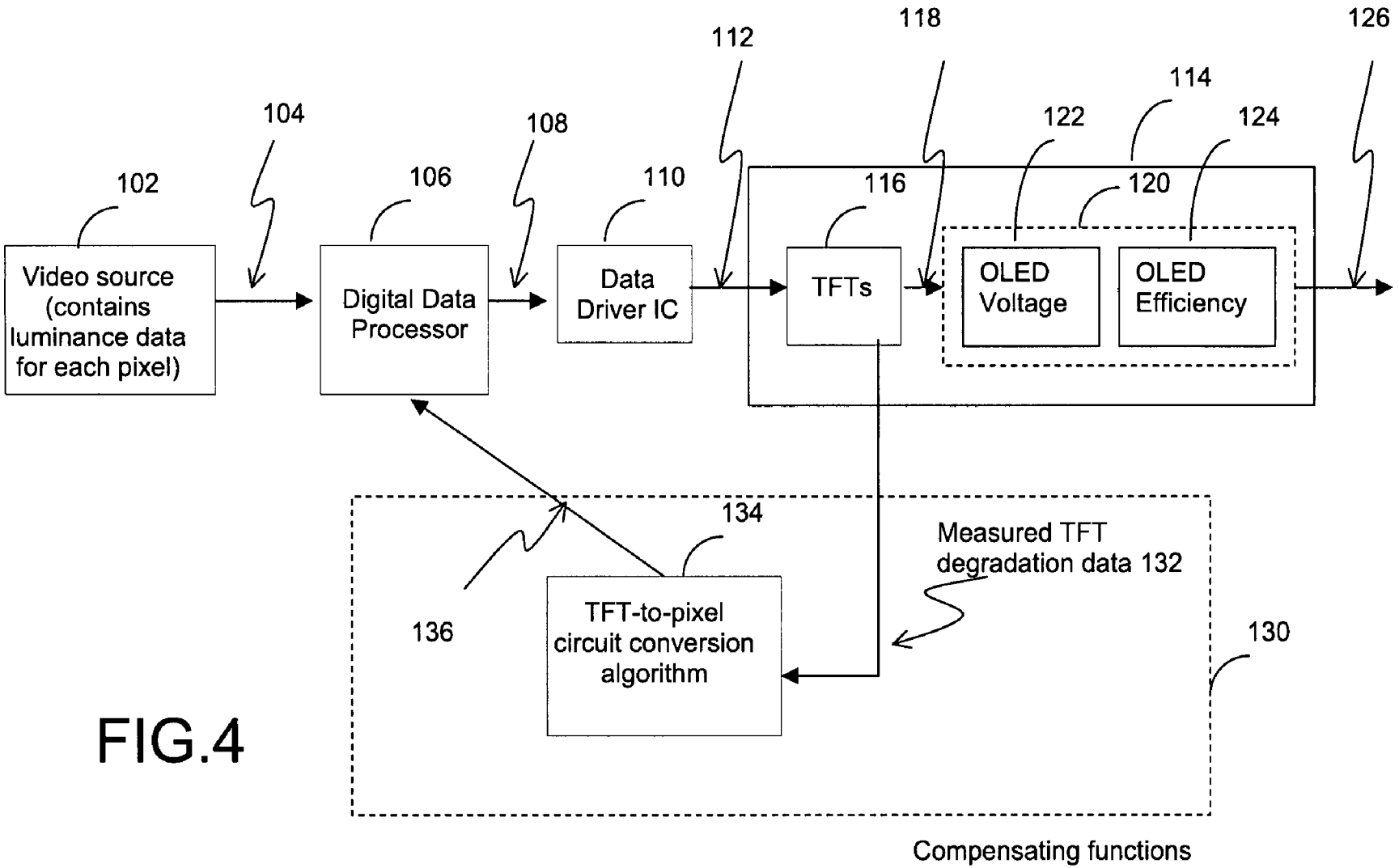
FIG. 4 illustrates an example of the light emitting display system of FIG. 3.

FIG. 4 illustrates an example of the system 100 of FIG. 3. The pixel circuit 114 of FIG. 4 includes TFTs 116 and OLED 120. The analog voltage or current 112 is provided to the TFTs 116. The TFTs 116 convert that voltage or current 112 into another current 118 which flows through the OLED 120. The OLED 120 converts the current 118 into the visible light 126. The OLED 120 has an OLED voltage 122, which is the voltage drop across the OLED. The OLED 120 also has an efficiency 134, which is a ratio of the amount of light emitted to the current through the OLED 120.

The system 100 of FIG. 4 measures the degradation of the TFTs only. The degradation of the TFTs 116 and the OLED 120 are usage-dependent, and the TFTs 116 and the OLED 120 are always linked in the pixel circuit 114. Whenever the TFT 116 is stressed, the OLED 120 is also stressed. Therefore, there is a predictable relationship between the degradation of the TFTs 116, and the degradation of the pixel circuit 114 as a whole. The TFT-to-pixel circuit conversion algorithm module 134 or the combination of the TFT-to-pixel circuit conversion algorithm module 134 and the digital data processor 106 estimates the degradation of the entire pixel circuit based on the TFT degradation only. The embodiment of the present invention may also be applied to systems that monitor both TFT and OLED degradation independently.

The pixel circuit 114 has a component that can be measured. The measurement obtained from the pixel circuit 114 is in some way related to the pixel circuit's degradation.

Figure 5:
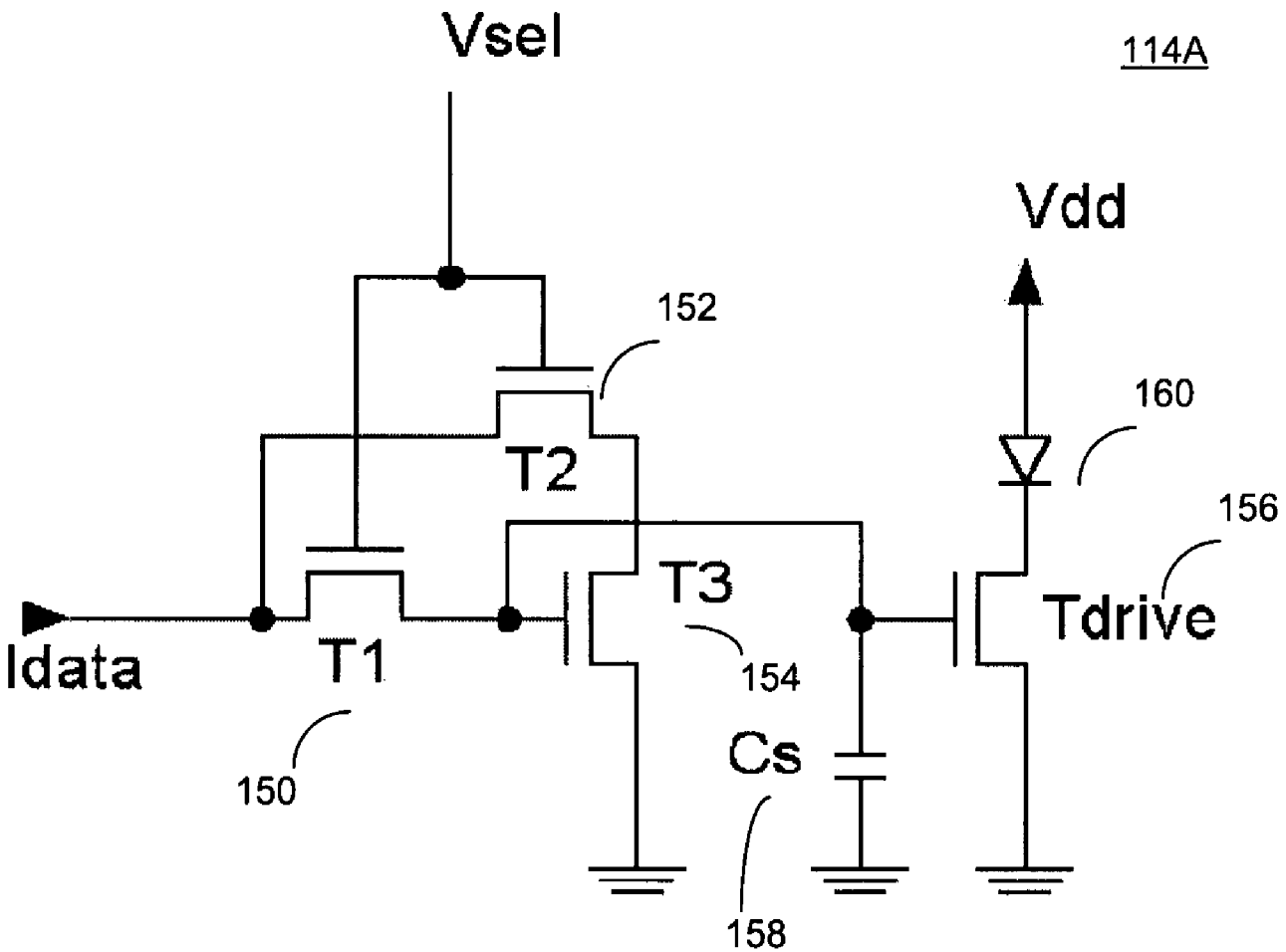
FIG. 5 illustrates an example of a pixel circuit of FIG. 4.

FIG. 5 illustrates an example of the pixel circuit 114 of FIG. 4. The pixel circuit 114 of FIG. 5 is a 4-T pixel circuit. The pixel circuit 114A includes a switching circuit having TFTs 150 and 152, a reference TFT 154, a drive TFT 156, a capacitor 158, and an OLED 160.

The gate of the switch TFT 150 and the gate of the feedback TFT 152 are connected to a select line Vsel. The first terminal of the switch TFT 154 and the first terminal of the feedback TFT 152 are connected to a data line Idata. The second terminal of the switch TFT 150 is connected to the gate of the reference TFT 154 and the gate of the drive TFT 156. The second terminal of the feedback TFT 152 is connected to the first terminal of the reference TFT 154. The capacitor 158 is connected between the gate of the drive TFT 156 and ground. The OLED 160 is connected between voltage supply Vdd and the drive TFT 156. The OLED 160 may also be connected between drive TFT 156 and ground in other systems (i.e. drain-connected format).

When programming the pixel circuit 114A, Vsel is high and a voltage or current is applied to the data line Idata. The data Idata initially flows through the TFT 150 and charges the capacitor 158. As the capacitor voltage rises, the TFT 154 begins to turn on and Idata starts to flow through the TFTs 152 and 154 to ground. The capacitor voltage stabilizes at the point when all of Idata flows through the TFTs 152 and 154. The current flowing through the TFT 154 is mirrored in the drive TFT 156.

In the pixel circuit 114A, by setting Vsel to high and putting a voltage on Idata, the current flowing into the Idata node can be measured. Alternately, by setting Vsel to high and putting a current on Idata, the voltage at the Idata node can be measured. As the TFTs degrade, the measured voltage (or current) will change, allowing a measure of the degradation to be recorded. In this pixel circuit, the analog voltage/current 112 shown in FIG. 4 is connected to the Idata node. The measurement of the voltage or current can occur anywhere along the connection between the data driver IC 110 and the TFTs 116.

In FIG. 4, the TFT-to-pixel circuit conversion algorithm is applied to the measurement 132 from the TFTs 116. However, current/voltage information read from various places other than TFTs 116 may be usable. For example, the OLED voltage 122 may be included with the measured TFT degradation data 132

Figure 6:
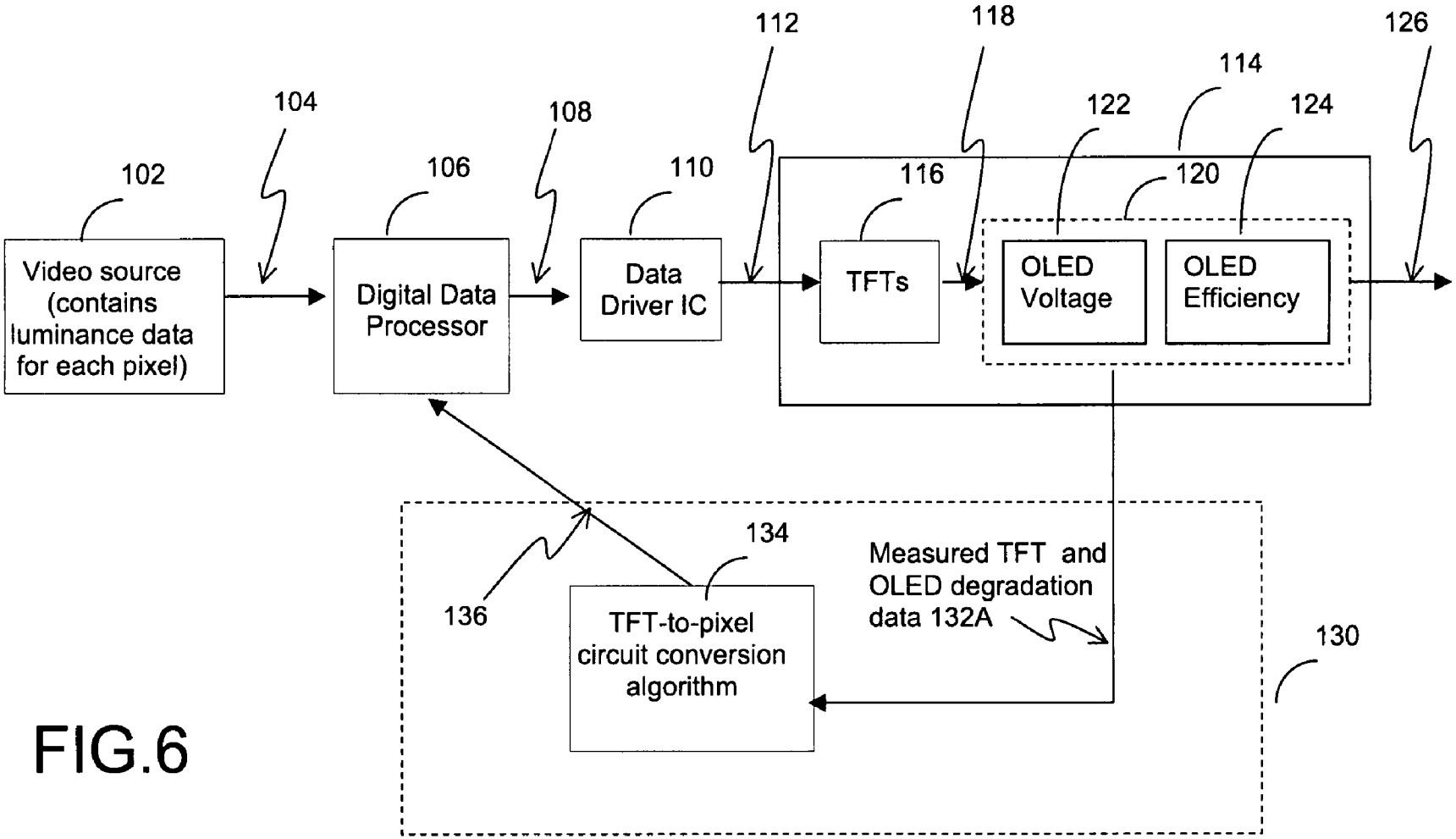
FIG. 6 illustrates a further example of the light emitting display system of FIG. 3.

FIG. 6 illustrates a further example of the system 100 of FIG. 3. The system 100 of FIG. 6 measures the OLED voltage 122. Thus, the measured data 132 is related to the TFT 116 and OLED 120 degradation ("measured TFT and OLED voltage degradation data 132A" in FIG. 6). The compensation functions module 130 of FIG. 6 implements the TFT-to-pixel circuit conversion algorithm 134 on the signal related to both the TFT degradation and OLED degradation. The TFT-to-pixel circuit conversion algorithm module 134 or the combination of the TFT-to-pixel circuit conversion algorithm module 134 and the digital data processor 106 estimates the degradation of the entire pixel circuit based on the TFT degradation and the OLED degradation. The TFT degradation and OLED degradation may be measured separately and independently.

Figure 7:
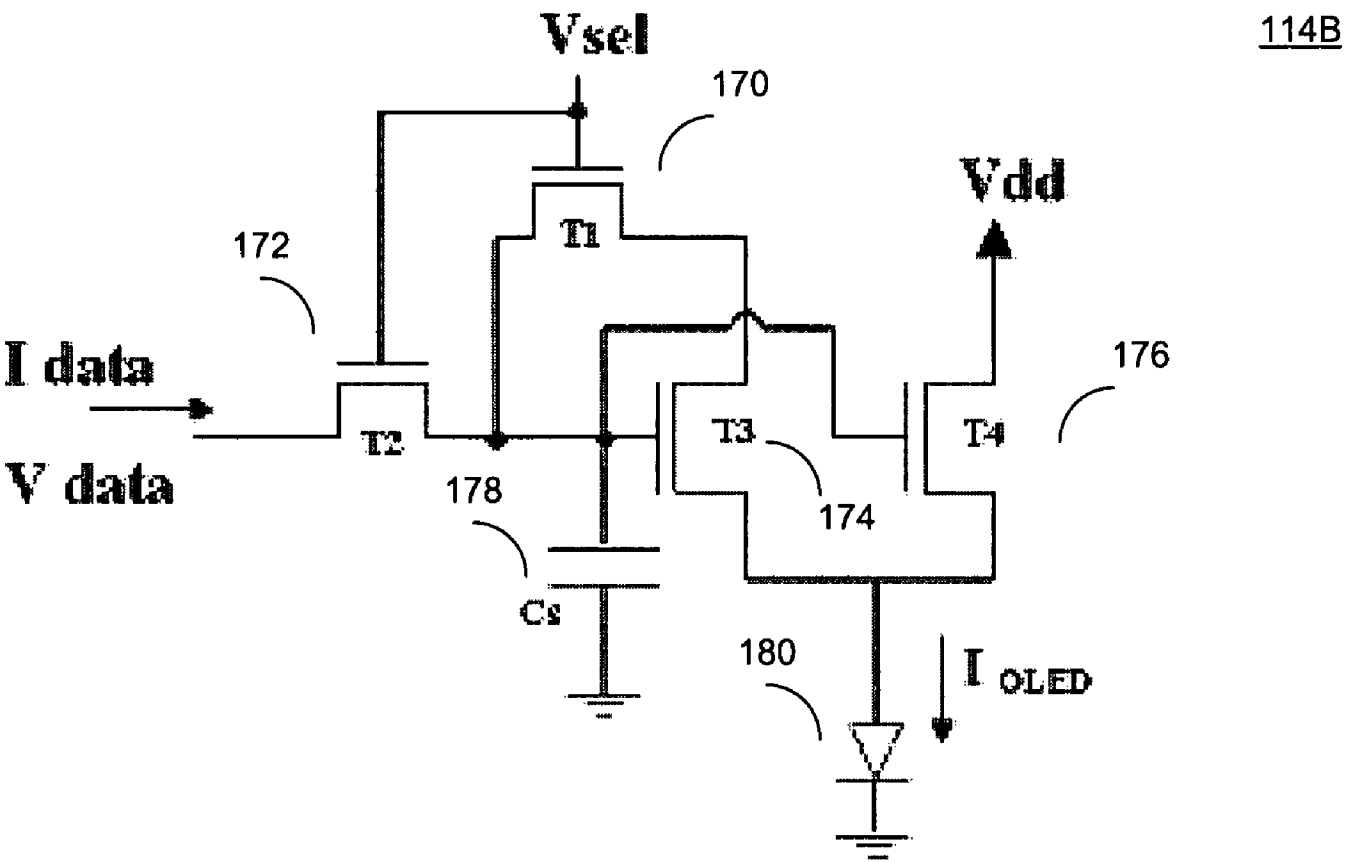
FIG. 7 illustrates an example of a pixel circuit of FIG. 6.

FIG. 7 illustrates an example of the pixel circuit 114 of FIG. 6. The pixel circuit 114B of FIG. 7 is a 4-T pixel circuit. The pixel circuit 114B includes a switching circuit having TFTs 170 and 172, a reference TFT 174, a drive TFT 176, a capacitor 178, and an OLED 180.

The gate of the switch TFT 170 and the gate of the switch TFT 172 are connected to a select line Vsel. The first terminal of the switch TFT 172 is connected to a data line Idata while the first terminal of the switch TFT 170 is connected to the second terminal of the switch TFT 172 which is connected to the gate of the reference TFT 174 and the gate of the drive TFT 176. The second terminal of the switch TFT 170 is connected to the first terminal of the reference TFT 174. The capacitor 178 is connected between the gate of the drive TFT 176 and ground. The first terminal of the drive TFT 176 is connected to voltage supply Vdd. The second terminal of the reference TFT 174 and the second terminal of the drive TFT 176 are connected to the OLED 180.

When programming the pixel circuit 114B, Vsel is high and a voltage or current is applied to the data line Idata. The data Idata initially flows through the TFT 172 and charges the capacitor 178. As the capacitor voltage rises, the TFT 174 begins to turn on and Idata starts to flow through the TFTs 170 and 174 and OLED 180 to ground. The capacitor voltage stabilizes at the point when all of Idata flows through the TFTs 152 and 154. The current flowing through the TFT 154 is mirrored in the drive TFT 156. In the pixel circuit 114A, by setting Vsel to high and putting a voltage on Idata, the current flowing into the Idata node can be measured. Alternately, by setting Vsel to high and putting a current on Idata, the voltage at the Idata node can be measured. As the TFTs degrade, the measured voltage (or current) will change, allowing a measure of the degradation to be recorded. It is noted that unlike the pixel circuit 114A of FIG. 5, the current now flows through the OLED 180. Therefore the measurement made at the Idata node is now partially related to the OLED Voltage, which will degrade over time. In the pixel circuit 114B, the analog voltage/current 112 shown in FIG. 6 is connected to the Idata node. The measurement of the voltage or current can occur anywhere along the connection between the data driver IC 110 and the TFTs 116.

Referring to FIGS. 3, 4 and 6, the pixel circuit 114 may allow the current out of the TFTs 116 to be measured, and to be used as the measured TFT degradation data 132. The pixel circuit 114 may allow some part of the OLED efficiency to be measured, and to be used as the measured TFT degradation data 132. The pixel circuit 114 may also allow a node to be charged, and the measurement may be the time it takes for this node to discharge. The pixel circuit 114 may allow any parts of it to be electrically measured. Also, the discharge/charge level during a given time can be used for aging detection.

Figure 8:
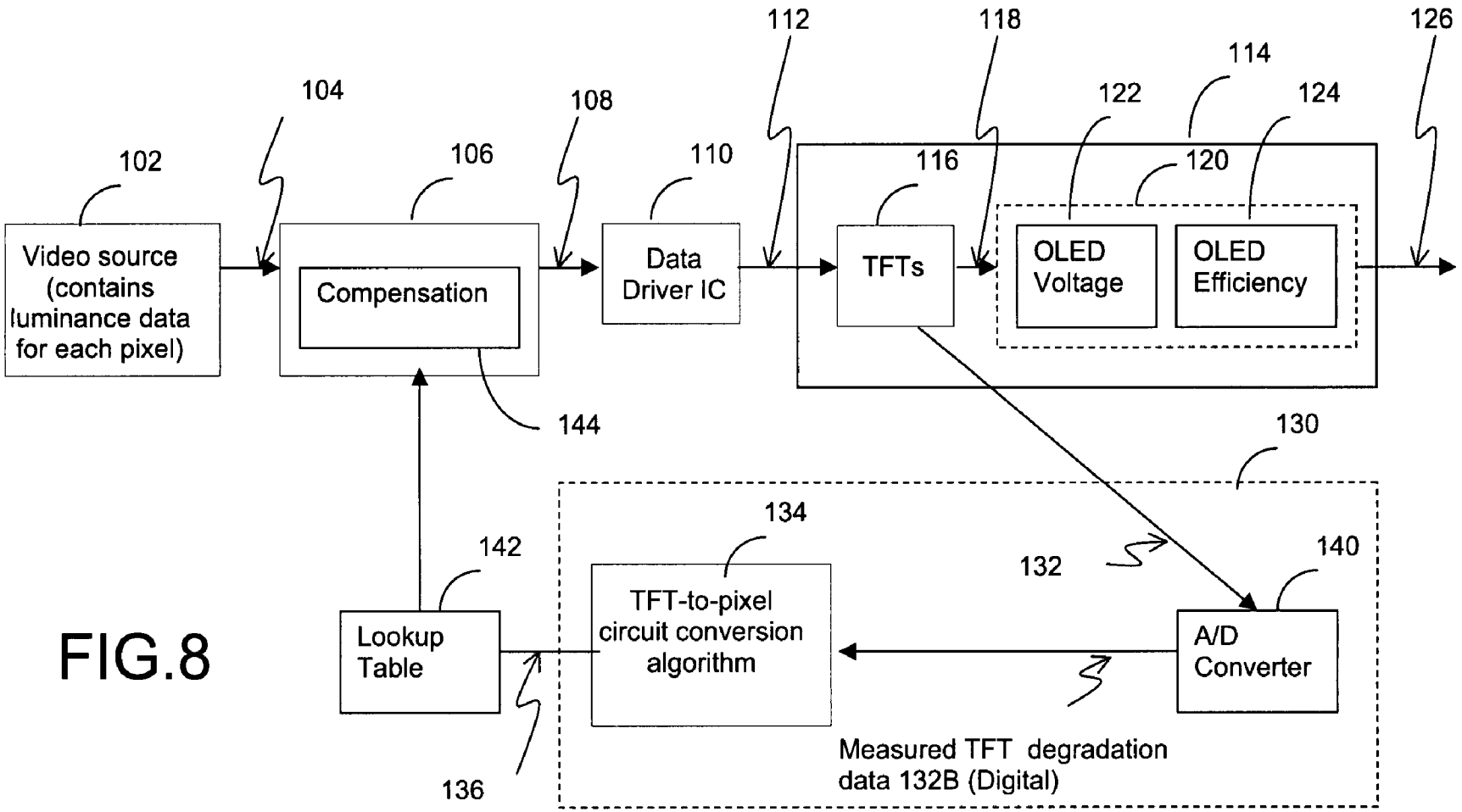
FIG. 8 illustrates an example of modules for the compensation scheme applied to the system of FIG. 4.

Referring to FIG. 8, an example of modules for the compensation scheme applied to the system of FIG. 4 is described. The compensation functions module 130 of FIG. 8 includes an analog/digital (A/D) converter 140. The A/D converter 140 converts the measured TFT degradation data 132 into digital measured TFT degradation data 132B. The digital measured TFT degradation data 132B is converted into the calculated pixel circuit degradation data 136 at the TFT-to-Pixel circuit conversion algorithm module 134. The calculated pixel circuit degradation data 136 is stored in a lookup table 142. Since measuring TFT degradation data from some pixel circuits may take a long time, the calculated pixel circuit degradation data 136 is stored in the lookup table 142 for use.

In FIG. 8, the TFT-to-pixel circuit conversion algorithm 134 is a digital algorithm. The digital TFT-to-pixel circuit conversion algorithm 134 may be implemented, for example, on a microprocessor, an FPGA, a DSP, or another device, but not limited to these examples. The lookup table 142 may be implemented using memory, such as SRAM or DRAM. This memory may be in another device, such as a microprocessor or FPGA, or may be an independent device.

The calculated pixel circuit degradation data 136 stored in the lookup table 142 is always available for the digital data processor 106. Thus, the TFT degradation data 132 for each pixel does not have to be measured every time the digital data processor 106 needs to use the data. The degradation data 132 may be measured infrequently (for example, once every 20 hours, or less). Using a dynamic time allocation for the degradation measurement is another case, more frequent extraction at the beginning and less frequent extraction after the aging gets saturated.

The digital data processor 106 may include a compensation module 144 for taking input luminance data for the pixel circuit 114 from the video source 102, and modifying it based on degradation data for that pixel circuit or other pixel circuit. In FIG. 8, the module 144 modifies luminance data using information from the lookup table 142.

It is noted that the configuration of FIG. 8 is applicable to the system of FIGS. 3 and 6. It is noted that the lookup table 142 is provided separately from the compensating functions module 130, however, it may be in the compensating functions module 130. It is noted that the lookup table 142 is provided separately from the digital data processor 106, however, it may be in the digital data processor 106.

Figure 9:
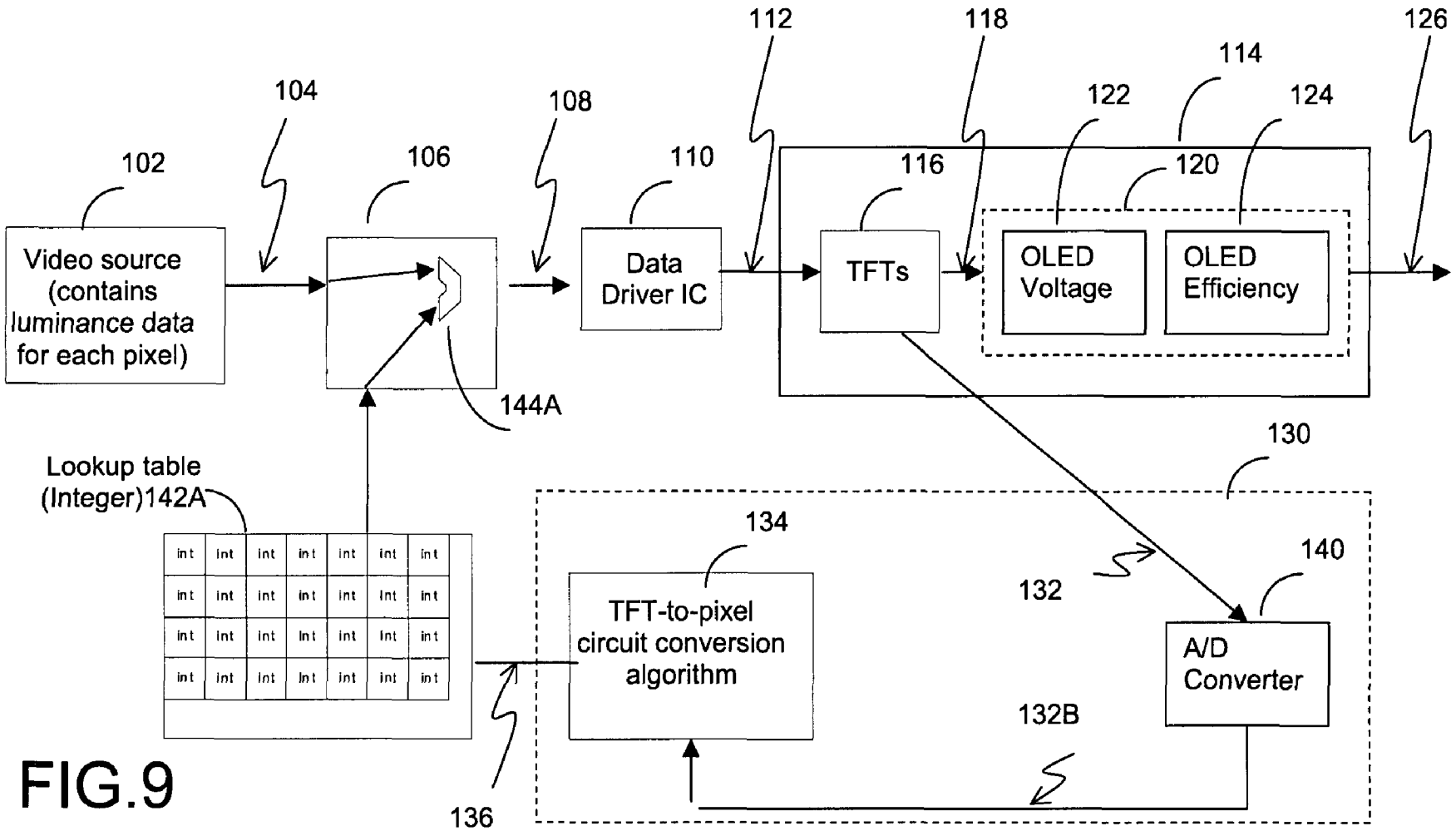
FIG. 9 illustrates an example of a lookup table and a compensation algorithm module of FIG. 7.

One example of the lookup table 142 and the module 144 of the digital data processor 106 is illustrated in FIG. 9. Referring to FIG. 9, the output of the TFT-to-pixel circuit conversion algorithm module 134 is an integer value. This integer is stored in a lookup table 142A (corresponding to 142 of FIG. 8). Its location in the lookup table 142A is related to the pixel's location on the AMOLED display. Its value is a number, and is added to the digital luminance data 104 to compensate for the degradation.

For example, digital luminance data may be represented to use 8-bits (256 values) for the brightness of a pixel. A value of 256 may represent maximum luminance for the pixel. A value of 128 may represent approximately 50% luminance. The value in the lookup table 142A may be the number that is added to the luminance data 104 to compensate for the degradation. Therefore, the compensation module (144 of FIG. 7) in the digital data processor 106 may be implemented by a digital adder 144A. It is noted that digital luminance data may be represented by any number of bits, depending on the driver IC used (for example, 6-bit, 8-bit, 10-bit, 14-bit, etc).

Figure 10:
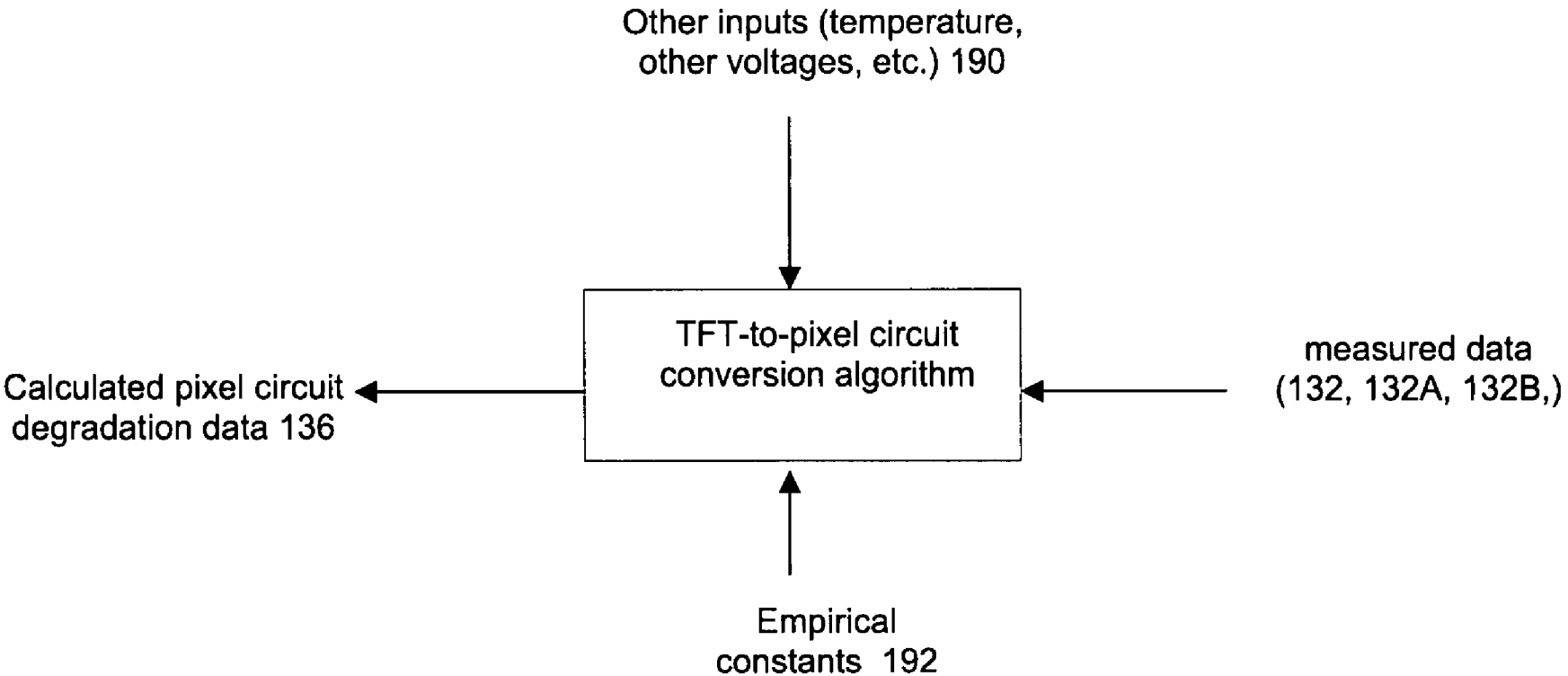
FIG. 10 illustrates an example of inputs to a TFT-to-pixel circuit conversion algorithm module.

In FIGS. 3, 4, 6, 8 and 9, the TFT-to-pixel circuit conversion algorithm module 134 has the measured TFT degradation data 132 or 132A as an input, and the calculated pixel circuit degradation data 136 as an output. However, there may be other inputs to the system to calculate compensation data as well, as shown in FIG. 10. FIG. 10 illustrates an example of inputs to the TFT-pixel circuit conversion algorithm module 134. In FIG. 10, the TFT-to-pixel circuit conversion algorithm module 134 processes the measured data (132 of FIGS. 3, 4, 8 and 9, 132A of FIG. 6, 132B of FIGS. 8 and 9) based on additional inputs 190 (e.g. temperature, other voltages etc), empirical constants 192 or combinations thereof.

The additional inputs 190 may include measured parameters such as voltage reading from current-programming pixels and current reading from voltage-programming pixels. These pixels may be different from a pixel circuit from which the measured signal is obtained. For example, a measurement is taken from a "pixel under test" and is used in combination with another measurement from a "reference pixel". As described below, in order to determine how to modify luminance data to a pixel, data from other pixels in the display may be used. The additional inputs 190 may include light measurements, such as measurement of an ambient light in a room. A discrete device or some kind of test structure around the periphery of the panel may be used to measure the ambient light. The additional inputs may include humidity measurements, temperature readings, mechanical stress readings, other environmental stress readings, and feedback from test structures on the panel.

It may also include empirical parameters 192, such as the brightness loss in the OLED due to decreasing efficiency ($\Delta L$), the shift in OLED voltage over time ($\Delta Voled$), dynamic effects of Vt shift, parameters related to TFT performance such as Vt, $\Delta Vt$, mobility ($\mu$), inter-pixel non-uniformity, DC bias voltages in the pixel circuit, changing gain of current-mirror based pixel circuits, short-term and long-term based shifts in pixel circuit performance, pixel-circuit operating voltage variation due to IR-drop and ground bounce.

Referring to FIGS. 8 and 9, the TFT-to-pixel-circuit conversion algorithm in the module 134 and the compensation algorithm 144 in the digital data processor 106 work together to convert the measured TFT degradation data 132 into a luminance correction factor. The luminance correction factor has information about how the luminance data for a given pixel is to be modified, to compensate for the degradation in the pixel.

In FIG. 9, the majority of this conversion is done by the TFT-to-pixel-circuit conversion algorithm module 134. It calculates the luminance correction values entirely, and the digital adder 144A in the digital data processor 106 simply adds the luminance correction values to the digital luminance data 104. However, the system 100 may be implemented such that the TFT-to-pixel circuit conversion algorithm module 134 calculates only the degradation values, and the digital data processor 106 calculates the luminance correction factor from that data. The TFT-to-pixel circuit conversion algorithm 134 may employ fuzzy logic, neural networks, or other algorithm structures to convert the degradation data into the luminance correction factor.

The value of the luminance correction factor may allow the visible light to remain constant, regardless of the degradation in the pixel circuit. The value of the luminance correction factor may allow the luminance of degraded pixels not to be altered at all; instead, the luminance of the non-degraded pixels to be decreased. In this case, the entire display may gradually lose luminance over time, however the uniformity may be high.

The calculation of a luminance correction factor may be implemented in accordance with a compensation of non-uniformity algorithm, such as a constant brightness algorithm, a decreasing brightness algorithm, or combinations thereof. The constant brightness algorithm and the decreasing brightness algorithm may be implemented on the TFT-to-pixel circuit conversion algorithm module (e.g. 134 of FIG. 3) or the digital data processor (e.g. 106 of FIG. 3). The constant brightness algorithm is provided for increasing brightness of degraded pixels so as to match non-degraded pixels. The decreasing brightness algorithm is provided for decreasing brightness of non-degraded pixels 244 so as to match degraded pixels. These algorithm may be implemented by the TFT-to-pixel circuit conversion algorithm module, the digital data processor (such as 144 of FIG. 8), or combinations thereof. It is noted that these algorithms are examples only, and the compensation of non-uniformity algorithm is not limited to these algorithms.

Referring to 11A-11E, the experimental results of the compensation of non-uniformity algorithms are described in detail. Under the experiment, an AMOLED display includes a plurality of pixel circuits, and is driven by a system as shown in FIGS. 3, 4, 6, 8 and 9. It is noted that the circuitry to drive the AMOLED display is not shown in FIGS. 11A-11E.

FIG. 11A schematically illustrates an AMOLED display 240 which starts operating (operation period t=0 hour). The video source (102 of FIGS. 3, 4, 7, 8 and 9) initially outputs maximum luminance data to each pixel. No pixels are degraded since the display 240 is new. The result is that all pixels output equal luminance and thus all pixels show uniform luminance.

Next, the video source outputs maximum luminance data to some pixels in the middle of the display as shown in FIG. 11B. FIG. 11B schematically illustrates the AMOLED display 240 which has operated for a certain period where maximum luminance data is applied to pixels in the middle of the display. The video source outputs maximum luminance data to pixels 242, while it outputs minimum luminance data (e.g. zero luminance data) to pixels 244 around the outside of the pixels 242. It maintains this for a long period of time, for example 1000 hours. The result is that the pixels 242 at maximum luminance will have degraded, and the pixels 244 at zero luminance will have no degradation.

At 1000 hours, the video source outputs maximum luminance data to all pixels. The results are different depending on the compensation algorithm used, as shown in FIGS. 11C-11E.

FIG. 11C schematically illustrates the AMOLED display 240 to which no-compensation algorithm is applied. As shown in FIG. 11C, if there was no compensation algorithm, the degraded pixels 242 would have a lower brightness than the non-degraded pixels 244.

FIG. 11D schematically illustrates the AMOLED display 240 to which the constant brightness algorithm is applied. The constant brightness algorithm is implemented for increasing luminance data to degraded pixels, such that the luminance data of the degraded pixels matches that of non-degraded pixels. For example, the increasing brightness algorithm provides increasing currents to the stressed pixels 242, and constant current to the unstressed pixels 244. Both degraded and non-degraded pixels have the same brightness. Thus, the display 240 is uniform. Differential aging is compensated, and brightness is maintained, however more current is required. Since the current to some pixels is being increased, this will cause the display to consume more current over time, and therefore more power over time because power consumption is related to the current consumption.

FIG. 11E schematically illustrates the AMOLED display 240 to which the decreasing brightness algorithm is applied. The decreasing brightness algorithm decreases luminance data to non-degraded pixels, such that the luminance data of the non-degraded pixels match that of degraded pixels. For example, the decreasing brightness algorithm provides constant OLED current to the stressed pixels 242, while decreasing current to the unstressed pixels 244. Both degraded and non-degraded pixels have the same brightness. Thus, the display 240 is uniform. Differential aging is compensated, and it requires a lower Vsupply, however brightness decrease over time. Because this algorithm does not increase the current to any of the pixels, it will not result in increased power consumption.

Figure 12:
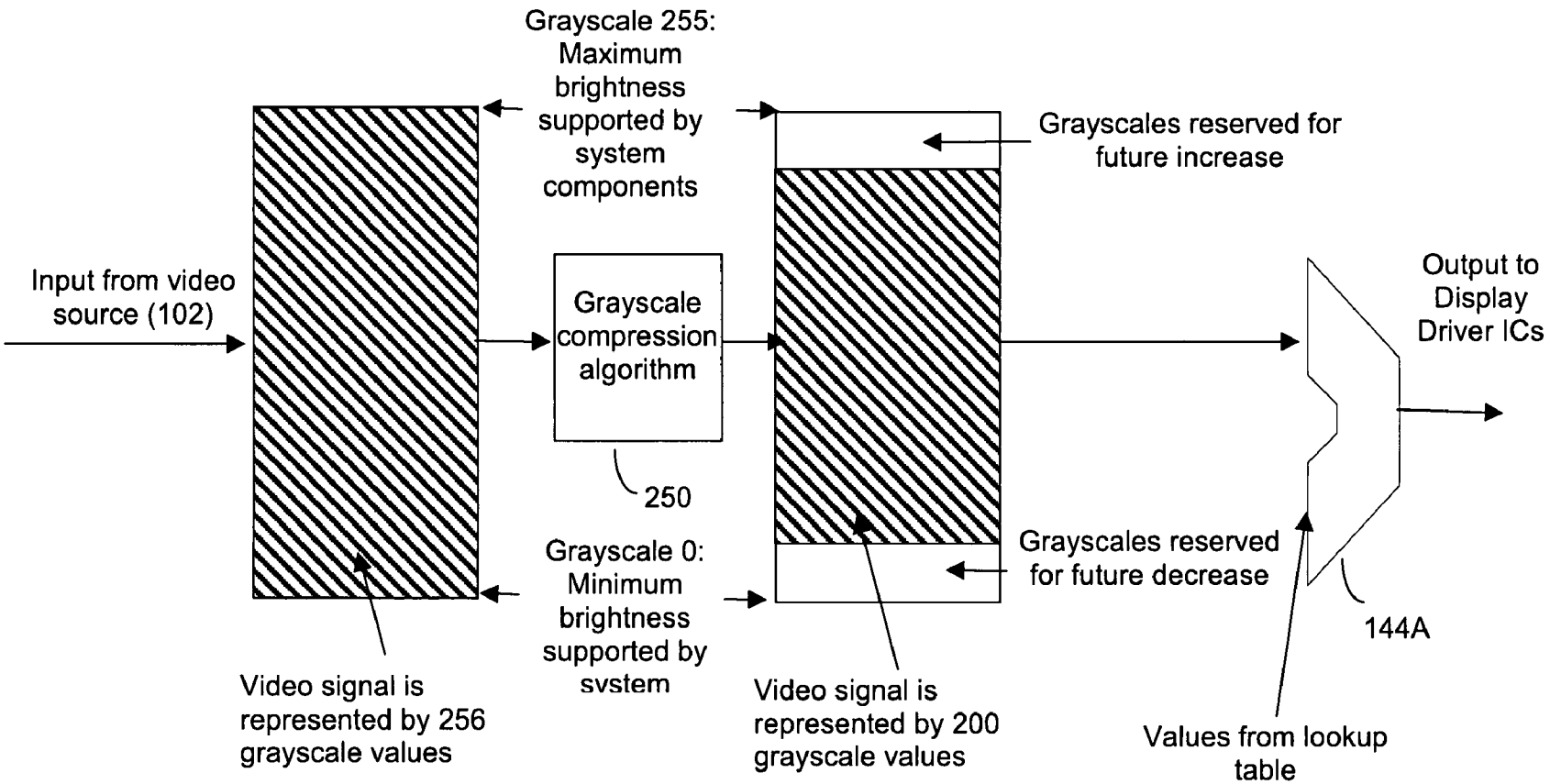
FIG. 12 illustrates an example of grayscale compression algorithm.

Referring to FIG. 3, components, such as the video source 102 and the data driver IC 110, may use only 8-bits, or 256 discrete luminance values. Therefore if the video source 102 outputs maximum brightness (a luminance value of 255), there is no way to add any additional luminance, since the pixel is already at the maximum brightness supported by the components in the system. Likewise, if the video source 102 outputs minimum brightness (a luminance value of 0), there is no way to subtract any luminance. The digital data processor 106 may implement a grayscale compression algorithm to reserve some grayscales. FIG. 12 illustrates an implementation of the digital data processor 106 which includes a grayscale compression algorithm module 250. The grayscale compression algorithm 250 takes the video signal represented by 256 luminance values, and transforms it to use less luminance values. For example, instead of minimum brightness represented by grayscale 0, minimum brightness may be represented by grayscale 50. Likewise, instead of maximum brightness represented by grayscale 200. In this way, there are some grayscales reserved for future increase and decrease. It is noted that the shift in grayscales does not reflect the actual expected shift in grayscales.

According to the embodiments of the present invention, the scheme of estimating (predicting) the degradation of the entire pixel circuit and generating a luminance correction factor ensures uniformities in the display. According to the embodiments of the present invention, the aging of some components or entire circuit can be compensated, thereby ensuring uniformity of the display.

According to the embodiments of the present invention, the TFT-to-pixel circuit conversion algorithm allows for improved display parameters, for example, including constant brightness uniformity and color uniformity across the panel over time. Since the TFT-to-pixel circuit conversion algorithm takes in additional parameters, for example, temperature and ambient light, any changes in the display due to these additional parameters may be compensated for.

The TFT-to-Pixel circuit conversion algorithm module (134 of FIGS. 3, 4, 6, 8 and 9), the compensation module (144 of FIG. 8, 144A of FIG. 9, the compensation of non-uniformity algorithm, the constant brightness algorithm, the decreasing brightness algorithm and the grayscale compression algorithm may be implemented by any hardware, software or a combination of hardware and software having the above described functions. The software code, instructions and/or statements, either in its entirety or a part thereof, may be stored in a computer readable memory. Further, a computer data signal representing the software code, instructions and/or statements, which may be embedded in a carrier wave may be transmitted via a communication network. Such a computer readable memory and a computer data signal and/or its carrier are also within the scope of the present invention, as well as the hardware, software and the combination thereof.

The present invention has been described with regard to one or more embodiments. However, it will be apparent to persons skilled in the art that a number of variations and modifications can be made without departing from the scope of the invention as defined in the claims.

What is claimed is:

1. A system for compensating non-uniformities in a light emitting device display, comprising:

a driver for driving a pixel array having a plurality of pixel circuits in an illumination operation and in a degradation estimation operation, each pixel circuit comprising:

a capacitor;

a first transistor selected by a select line;

a second transistor coupled to a light emitting device; and a third transistor and a fourth transistor coupled between a data line and a potential in series;

wherein each transistor has a gate terminal, the gate terminal of the first transistor and the gate terminal of the third transistor coupled to the select line, the gate terminal of the fourth transistor and the capacitor coupled to the gate terminal of the second transistor, the first transistor coupled to the data line and the gate terminal of the second transistor;

a measuring module for measuring current or voltage on the data line coupled to a first-pixel circuit in the degradation estimation operation; and a modifying module for modifying pixel data, the pixel data being applied to the first pixel circuit or a second pixel circuit-in the pixel array in the illumination operation, including:

an estimating module for estimating a degradation of the first pixel circuit based on the measured current or voltage; and a compensating module for correcting the pixel data based on the estimated degradation of the first pixel circuit.

2. A system according to claim 1, wherein the modifying module implements a constant algorithm for increasing luminance data applied to a degraded pixel circuit such that the luminance data of the degraded pixel circuit matches that of a non-degraded pixel circuit.

3. A system according to claim 1, wherein the modifying module implements a decreasing algorithm for decreasing luminance data applied to a non-degraded pixel circuit in the pixel array based on the estimated degradation such that the luminance data of the non-degraded pixel circuit matches that of a degraded pixel circuit in the pixel array.

4. A system according to claim 2, wherein at least one of the estimating module and the compensating module produces a correction factor in accordance with the constant algorithm.

5. A system according to claim 3, wherein at least one of the estimating module and the compensating module produces a correction factor in accordance with the decreasing algorithm.

6. A system according to claim 1, wherein the estimating module includes estimating the degradation of the first pixel circuit based on the measured current or voltage together with electrical data measured from the light emitting device, the electrical data being measured separately from the measurement of the current or voltage.

7. A system according to claim 1, wherein the measured current or voltage being associated with the transistor, the light emitting device, or combinations thereof.

8. A system according to claim 1, wherein the modifying module dynamically allocates a timing of the measurement, a timing of the correction, or a combination thereof.

9. A system according to claim 8, wherein the modifying module includes a memory for storing compensation data or the measurement.

10. A system according to claim 1, wherein the estimating module estimates the degradation of the first pixel circuit based on the measured current or voltage together with one or more additional measurement inputs, one or more empirical parameters or combinations thereof.

11. A system according to claim 10, wherein the one or more additional measurement inputs include at least one of voltage reading from one or more current-programming pixels, current reading from one or more voltage-programming pixel, measurement of an ambient light, humidity measurement, temperature measurement, mechanical stress measurement, environmental stress measurement, and feedback from test structures on the display.

12. A system according to claim 10, wherein the one or more empirical parameters include at least one of brightness loss in a light emitting device of the pixel circuit due to decreasing efficiency ($\Delta L$), a shift in the light emitting device diode voltage over time ($\Delta$Voled), dynamic effects of threshold shift, parameters related to performance of a pixel transistor including threshold, threshold shift, mobility ($\mu$), inter-pixel non-uniformity, DC bias voltages in the pixel circuit, changing gain of current-mirror based pixel circuits, short-term and long-term based shifts in pixel circuit performance, pixel-circuit operating voltage variation due to IR-drop and ground bounce.

13. A system according to claim 1, wherein the compensation module compensates for the non-uniformity due to process or construction inequality in the display, aging of one or more pixel circuits, or combinations thereof.

14. A system according to claim 1, wherein the compensating module includes grayscale compression module for implementing a gray scale compression algorithm on luminance data applied to the first or second pixel circuit to reserve grayscale values.

15. A system according to claim 14, wherein the gray scale compression algorithm module transforms the luminance data so as to use luminance values less than those of the original luminance data.

16. A system according to claim 1, wherein the transistors are thin-film-transistors.

17. A system according to claim 1, wherein the light emitting device is an organic light emitting device.

18. A system according to claim 1, wherein the fourth transistor in each pixel circuit is coupled to the light emitting diode and the second transistor.

19. A system according to claim 1, wherein the modifying module applying the pixel data to the first pixel circuit and the second pixel circuit in the pixel array in the illumination operation.

20. A method of compensating non-uniformities in a light emitting device display having a pixel array including a plurality of pixel circuits, each pixel circuit having:

a capacitor;

a first transistor selected by a select line;

a second transistor coupled to a light emitting device; and a third transistor and a fourth transistor coupled between a data line and a potential in series;

wherein each transistor has a gate terminal, the gate terminal of the first transistor and the gate terminal of the third transistor coupled to the select line, the gate terminal of the fourth transistor and the capacitor coupled to the gate terminal of the second transistor, the first transistor coupled to the data line and the gate terminal of the second transistor;

the method of compensating comprising:

in a degradation estimation operation, operating on a first pixel circuit in the pixel array, including:

operating on the select line coupled to the first pixel circuit in a manner same as that of an illumination operation;

operating on the data line coupled to the first pixel circuit; and measuring current or voltage on the data line coupled to the first pixel circuit;

estimating a degradation of the first pixel circuit based on the measured current or voltage; and correcting pixel data applied to the first pixel circuit or a second pixel circuit in the pixel array in the illumination operation, based on the estimated degradation of the first pixel circuit.

21. A method according to claim 20, wherein the correcting step includes:

increasing luminance data to a degraded pixel circuit such that the luminance data of the degraded pixel circuit matches that of a non-degraded pixel circuit.

22. A method according to claim 20, wherein the correcting step includes:

decreasing luminance data to a non-degraded pixel circuit in the pixel array based on the estimated degradation such that the luminance data of the non-degraded pixel circuit matches that of a degraded pixel circuit in the pixel array.

23. A method according to claim 20, wherein the method further comprises:

measuring electrical data from the light emitting device, the electrical data being measured separately from the measurement of the current or voltage, and the estimating step including the electrical data from the light emitting device when estimating the degradation of the first pixel circuit.

24. A method according to claim 20, wherein the the measured current or voltage being associated with the one or more the transistors, the light emitting device, or combinations thereof.

25. A method according to claim 20, further including the step of dynamically allocating a timing of the measurement, a timing of the correction, or a combined thereof.

26. A method according to claim 20, further including the step of compressing grayscales of luminance data applied to the first or second pixel circuit to reserve one or more grayscale values.

27. A method according to claim 26, wherein the compressing step includes the step of transforming the luminance data so as to use luminance values less than those of the original luminance data.

28. A method according to claim 20, wherein the correcting pixel data is applied to the first pixel circuit and the second pixel circuit in the pixel array in the illumunication based on the estimation of the first pixel circuit.

* * * * *